United States Patent [19]

Edel et al.

[11] Patent Number: 4,584,076

[45] Date of Patent: Apr. 22, 1986

[54] PROCESS FOR OBTAINING LIGNIN FROM ALKALINE SOLUTIONS THEREOF

[75] Inventors: Eugen Edel; Josef Feckl; Clemens Grambow, all of Munich; Albert Huber, Dachau; Dietrich Wabner, Munich, all of Fed. Rep. of Germany

[73] Assignee: MD-Organocell Gesellschaft fuer Zellstoff- und Umwelttechnik mbH, Fed. Rep. of Germany

[21] Appl. No.: 665,882

[22] Filed: Oct. 29, 1984

[30] Foreign Application Priority Data

Oct. 31, 1983 [DE] Fed. Rep. of Germany ..... 3339449

[51] Int. Cl.[4] ..... B01D 13/02

[52] U.S. Cl. ..... 204/182.4; 204/149; 204/151; 204/182.6

[58] Field of Search ..... 204/180 P, 263–270, 204/151, 283, 284, 301, 149

[56] References Cited

U.S. PATENT DOCUMENTS

| | | | |
|---|---|---|---|
| 3,525,682 | 8/1970 | McRae et al. | 204/182.6 |
| 3,897,319 | 7/1975 | Anderson et al. | 204/78 |
| 3,905,886 | 9/1975 | Wang | 204/180 P |
| 4,043,896 | 8/1977 | Ahlgren | 204/180 P |
| 4,049,490 | 9/1977 | Zaplatin et al. | 204/180 P |
| 4,123,342 | 10/1978 | Ahlgren | 204/180 P |
| 4,140,615 | 2/1979 | Kadija et al. | 204/283 |
| 4,273,628 | 6/1981 | Kidon et al. | 204/87 |
| 4,397,719 | 8/1983 | Yoshida | 204/264 |
| 4,476,025 | 10/1984 | Chum et al. | 210/638 |

*Primary Examiner*—John F. Niebling
*Assistant Examiner*—Terryence Chapman
*Attorney, Agent, or Firm*—Robert J. Koch

[57] ABSTRACT

The invention relates to a method and apparatus for recovering lignin and alkali from an alkaline lignin solution. One or more electrolytic cells are used to anodically acidify the lignin and simultaneously cathodically regenerate alkali. The invention is especially advantageous for the preparation of pure lignin and alkali from the waste liquor of a cellulose process.

28 Claims, 3 Drawing Figures

20
21
21a
21b
22
23
24
25
26
27
28
29
30
31
32
33
34
35
35a
36
37
38
39
40
Na+
Na+
$H_2$
$H_2$

PROCESS FOR OBTAINING LIGNIN FROM ALKALINE SOLUTIONS THEREOF

BACKGROUND OF THE INVENTION

1. Field of the Invention

The invention relates generally to lignin recovery processes and, more specifically, to methods for recovering lignin through neutralization of alkaline lignin solutions. In particular, the invention relates to an electrochemical method whereby both lignin and alkali are recovered in anode and cathode chambers, respectively, of one or more electrochemical cells. The invention is ideally suited for recovering lignin from the alkaline extract of a cellulose process.

2. Background of the Invention

In the production of cellulose, considerable amounts of lignin-containing extracts are obtained which have heretofore represented a waste product. As the direct discharge of the extracts into waterways is no longer possible at the present time, the extracts have been subjected to a concentration process, and the solid materials obtained usually burned. The methods used in the process are expensive and have been employed only to obtain purified water and solids separated therefrom. The water may then be returned to the waterways. The process is not only expensive, but the lignin contained in the solids is destroyed. The extracts are usually designated waste liquors.

A method for precipitating lignin from an alkaline solution is known, whereby the solution is neutralized by the introduction of acids, but a subsequent recovery of the lye is not possible or is highly involved and expensive. Furthermore, the material precipitated in this manner is contaminated by mineral salts. Alkaline liquors may be neutralized, for example, by the introduction of carbon dioxide, and the carbonate so-formed, causticized with calcium oxide. There remains, however, a need in the art for an inexpensive method for recovering both lignin and alkali from an alkaline lignin solution.

SUMMARY OF THE INVENTION

It is accordingly an object of the invention to provide a process whereby lignin is obtained, with a low apparative expenditure, from an alkaline lignin solution. Preferably the lignin solution is waste liquor, i.e. alkaline extract, obtained from a cellulose process in a form suitable for further processing. In the method of the invention, destruction of the lignin is avoided and, further, the possibility exists for recycling the water component and the alkali of the extract to the process for further use.

The above-stated object is attained in a process according to the invention, in which lignin solution is continuously anodically acidified by electrolysis and, in the same process, alkali is cathodically regenerated. In other words, the alkaline extract (lignin solution) is introduced into the anode chamber of a divided electrolytic cell and electrochemically acidified therein, while simultaneously, in the cathode chamber, the liquor is electrochemically concentrated. The cell is appropriately divided by an ion exchange membrane, which makes the selective transportive of cations from the anode into the cathode chamber possible. Investigations have shown that a Nafion membrane is especially suitable, both satisfying the requirements, and having a useful life. Precipitation and recovery of the liquor are effected simultaneously by the supply of the single amount of energy. The process may be carried out in a single stage or may include multiple stages. A preferred embodiment utilizes multiple stages in which anolyte and catholyte are circulated.

DETAILED DESCRIPTION OF THE PREFERRED EMBODIMENTS

The process of the invention is generally applicable to alkaline lignin solutions. It is used principally, however, for alkaline lignin solutions consisting of an extract or waste liquor of a cellulose process, and preferably for lignin solutions obtained from the extract of an organosolv process for the production of cellulose by the separation of the organic solvent. Sodium hydroxide is preferably used as the alkali.

Figure 1:
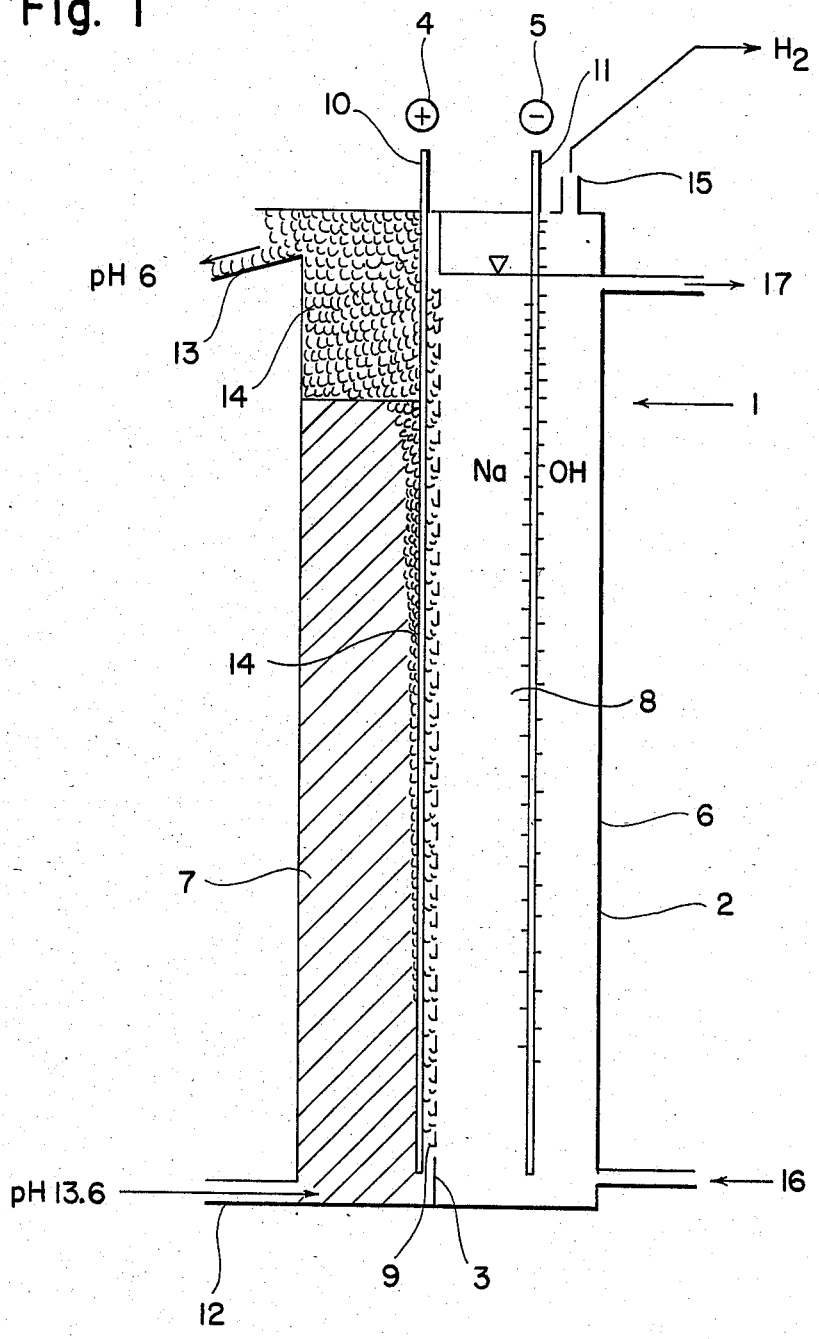
FIG. 1 shows an electrolysis cell conducting the process in a single stage, according to one embodiment of the invention.
Figure 2:
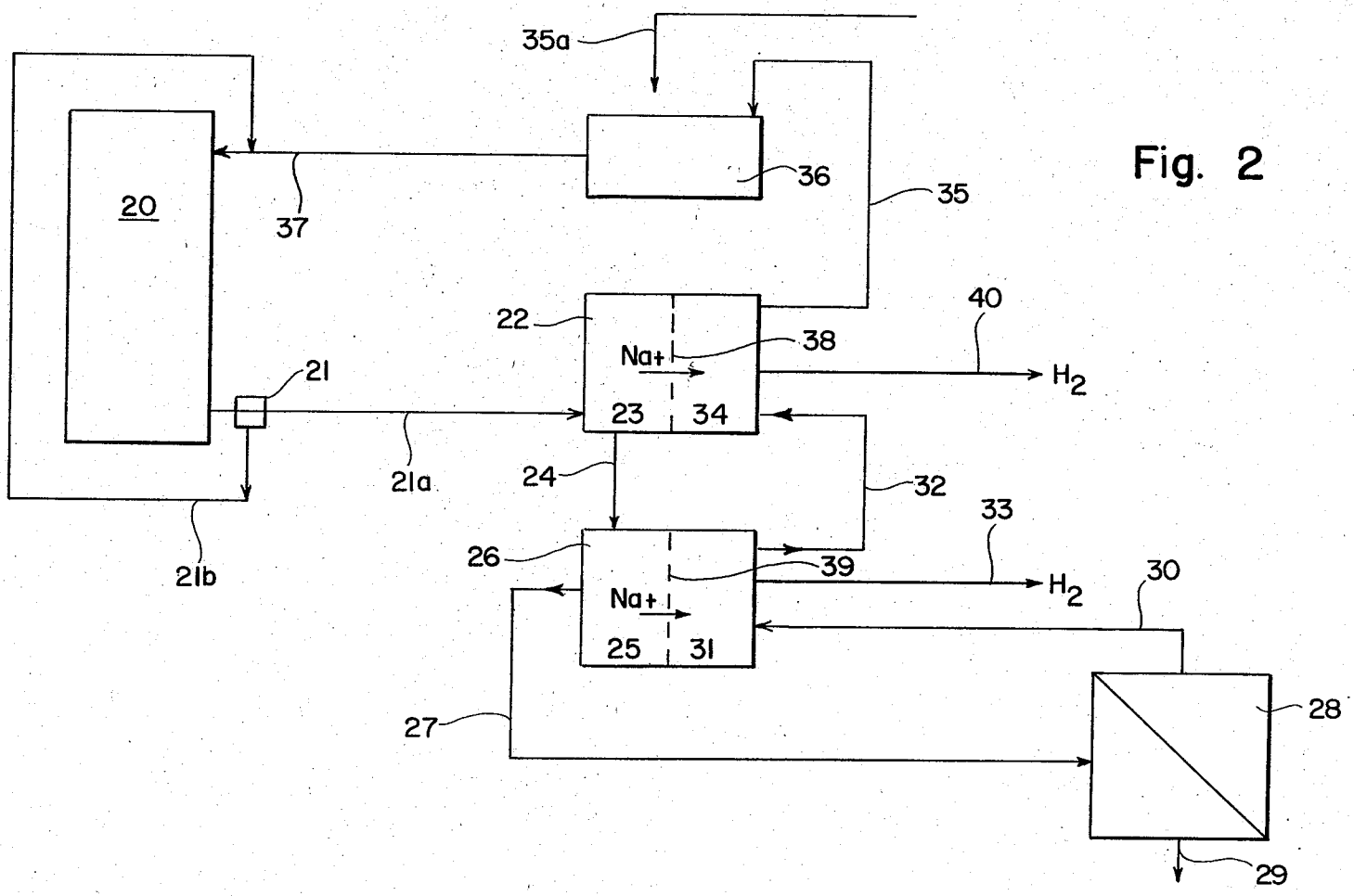
FIG. 2 is a schematic diagram of a second embodiment of the invention utilizing a two-stage process.
Figure 3:
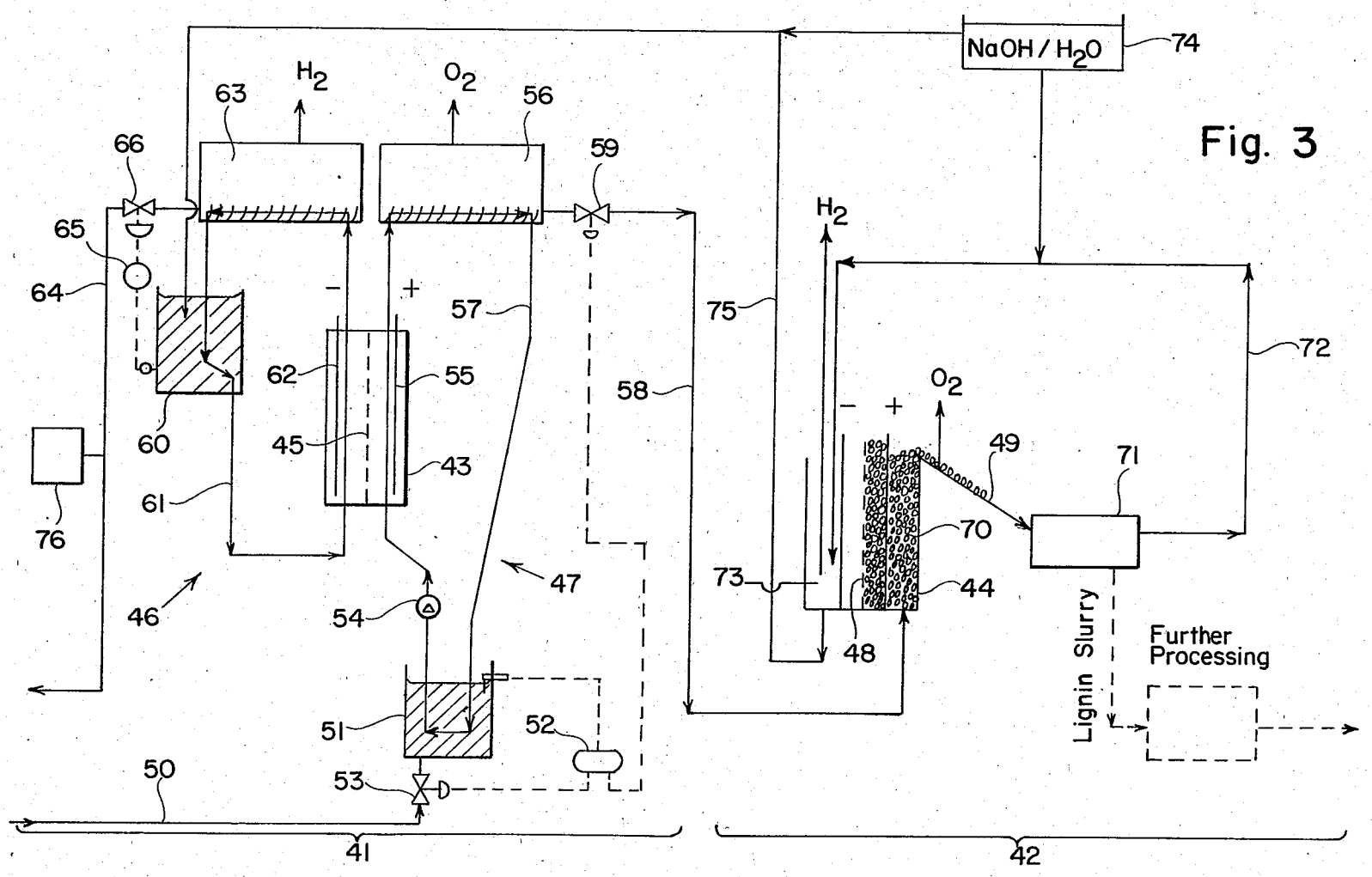
FIG. 3 illustrates a preferred embodiment of the two stage process of FIG. 2.

It has been discovered that the process may be conducted in a single electrolysis cell, as illustrated in FIG. 1 or in multiple stages, as shown in FIGS. 2 and 3. In the single stage process, lignin solution and alkali are conducted through an electrolysis cell, which is divided by a cation exchange membrane into anode and cathode chambers. At one end of the cell, a light brown lignin foam is obtained that may be further processed by known methods to produce pure lignin.

In FIG. 1, the electrolysis cell 1 comprises a housing 2, membrane 3, anode 4 and cathode 5. The anode and cathode are in the form of metal grids which are approximately the same size and shape as the membrane. The anode 4 is preferably a coarse metal grid. The housing 2 is in the form of a flat, quadrangular block, in the center of which, the membrane 3 is inserted. The size of the membrane corresponds approximately to the magnitude of one of the lateral surfaces 6 of the housing 2. The membrane 3 divides the inside of the housing 2 into anode and cathode chambers 7 and 8, respectively. The anode 4 and the cathode 5 are arranged in chambers 7 and 8. Both are adapted in their configuration and size to the membrane 3. The cathode is located approximately in the center of the cathode chamber 8, while the anode 4 is located adjacent to the membrane 3, so that between the anode 4 and the membrane 3 there is only a relatively narrow gap 9. Power connections 10 and 11 for the anode 4 and the cathode 5 are conducted out of the housing 2.

Waste liquor, for example, from a cellulose process, which has previously been freed of methanol, is conducted to the anode chamber of cell 1 through inlet 2. In the course of the electrolysis, in the anode chamber 7, a foam of lignin and oxygen is formed which is drawn off through the outlet 13. The foam generation is indicated in the drawing by bubbles 14. Lignin foam 14 the outlet 13 is centrifuged, whereby pure lignin and a solution that may be recycled into the cellulose process, are obtained. Hydrogen generated in the process escapes through a connecting fitting 15 on the cathode chamber 8. Water, dilute alkaline liquor, or the centrifugate of the lignin foam (pH 6) are introduced through the fitting 16. Concentrated alkaline liquor is drawn off through fitting 17 from the cathode chamber.

A second embodiment of the invention is illustrated in FIG. 2. It has been found that if the process is performed in two or even three stages, the expenditure of energy is especially low. The number of stages utilized is, in fact, limited by the equipment expenditure required and the efficiency that may be obtained.

The process shown in FIG. 2 is in two stages and illustrates an application of the invention to a cellulose process. From the cellulose boiler 20, the lignin and methanol-containing extract is drawn off and freed of methanol in a methanol recovery installation 21. The methanol is then returned through line 21*b* to the pulping process. The extract, free of methanol, is conducted through line 21*a* to the first electrolysis cell 22, which essentially represents the first process stage. The extract is passed to the anode chamber 23.

In the anode chamber 23, the extract is acidified until a pH value of 9.5 is attained. From the anode chamber the extract, having this pH value, is passed continuously through line 24 to the anode chamber 25 of the second electrolysis cell 26, which forms the second process stage. In this cell 26, another electrolytic acidification, and thus foam formation, takes place. The foam is removed by means of the drainage installation 27 in the form of a lignin suspension, and is passed to a separating device 28, wherein the precipitated lignin contained in the foam is separated from the extract. The pure lignin is conveyed by conveying means 29 to further processing, while the remaining extract, comprising acidic anolyte, is routed to the cathode chamber 31, via line 30, as a near lignin-free solution.

In the cathode chamber 31, the extract is electrolytically enriched with alkali. The hydrogen generated in the process is exhausted through outlet 33. From the cathode chamber 31, the extract travels through line 32 into cathode chamber 34 of the first cell 22. Here, the extract is further enriched in alkali and passes through line 25 into a collecting vessel 36. By means of line 35*a*, the sodium hydroxide concentration may be regulated. From the collecting vessel 36, the extract is transported in the form of caustic liquor through line 37 and recycled to the cellulose boiler 20. Hydrogen is eliminated through line 40. The Nafion membranes present between the anode and cathode chambers are designated 38 and 39 respectively.

In the first stage 22, also referred to as the neutralization cell, neutralization is carried only to the onset of lignin precipitation in the anode chamber, which, in keeping with experience, corresponds to a pH of about 9.5. In this stage, the greater portion of the sodium hydroxide in the cathode space is recovered. In the second stage 26, also known as the flocculation cell, the anode chamber is acidified to complete precipitation of the lignin, which, according to experience, is about pH 4. Because of the low conductivity of solutions below pH 8, adequate electrolysis takes place only at higher voltages. Appreciable amounts of energy are saved by the separation into two stages.

The oxygen which develops at the anode of the second stage flocculation cell 26, forms, together with the precipitated lignin and a part of the neutralized solution, a foam similar to lignin foam 4 of the single stage embodiment. The lignin suspension so formed is removed by the separating device 28, which is preferably a flotation installation. The flotation process requires no additional energy, as the oxygen is generated by the amount of energy necessary for the electrolysis.

Electrolytically precipitating the lignin in the second stage has the advantage that the recovered lignin is not contaminated by inorganic salts.

The separating device 28 may be, for example, a centrifuge. The acidic anolyte recovered from the separating device 28 in line 30 may, instead of being routed to cathode chamber 31, as shown in FIG. 2, be recycled to cathode chamber 34 of the first process stage 22 and, after suitable regeneration, addition of methanol and enrichment in alkali, if necessary, recycled to the cellulose boiler. The regenerated extract can be used as the digestion medium, or as one of the components thereof, in the cellulose process. The processing of the alkaline extract may thus be effected in a closed circulation with no waste water leaving the process.

The electrolysis is carried out in both stages at the highest temperatures possible, below the boiling temperature, as the conductivity of the solution increases with rising temperature. The waste heat obtained during the electrolysis is sufficient to maintain this temperature, so that supplemental heating of the electrolytic cells is usually not necessary.

As the electrolytic process is a relatively gentle method, not requiring the use of additional chemicals, it is suitable in particular for obtaining pure, natural lignin, such as provided, for example, by the organosolv process according to German patent application No. P 28 55 052.

It is especially advantageous to circulate the catholyte and/or the anolyte in the first process stage, as illustrated in FIG. 3. A portion of the circulation routes is formed by the electrolytic cells themselves. The conduction of the anolytes and the catholytes, in circulation with the inclusion and exclusion of a portion of the electrolytes, improves the control of the process stage. By means of very simple control devices it is possible to obtain the neutralization desired in the first process stage in a very simple manner and with observation of exact values. The acidification of the waste liquor in the first process stage is carried, preferably, to a pH of 9.5, as in the previously described embodiment. However, this value is not absolute, but depends on conditions such as the lignin content of the waste liquor, temperature, and the like. Also as previously described, the flocculation of the lignin components occurs in the second process stage only, where it is removed by means of flotation equipment. Limiting flocculation to the second stage has the additional advantage, in this embodiment, of avoiding contamination of the circulation passages.

As shown in FIG. 3, process steps 41 and 42 are equipped with electrolytic cells 43 and 44, respectively. The flocculated electrolytes obtained in the second process stage are returned to the first stage. The first process stage 41 comprises cell 43, divided by membrane 45, and the two circulation loops 46 and 47 for the catholytes and anolytes. Process stage 42 comprises cell 44, also equipped with a membrane 48, and the flotation device 49.

The lignin-containing extract obtained in the cellulose pulping process, also designated the waste liquor, has a pH value of 14 and a lignin content of about two percent to ten percent by weight, and is conducted through line 50 to the reservoir 51. By means of a controlled system 52, 53, 59, which comprises the pH and level controller, this supply of waste liquor is regulated so that, in the reservoir, a pH value of about 9.5 is maintained. The pump 54 transports the waste liquor into the cell 43, specifically into the anode chamber 55. In the anode chamber 55, the pH of the waste liquor is lowered. The waste liquor then enters a gas separator 56, where the anode gas, mainly oxygen generated during the electrolysis, is separated. While the major part of the anolyte flows back from the gas separator 56 through line 57 into the reservoir 51, part of the lignin-containing extract or anolyte, having a pH value of about 9.5. is removed through line 58 and passes to the cell 44 of the second process stage. A valve 59, set into line 58, is controlled by a level regulator in the reservoir 51.

The liquid in the cathode chamber 62 comprises the deflocculated catholyte, which has already been enriched in sodium hydroxide in the cathode chamber 73 of cell 44, and has a pH of approximately 12. This catholyte passes through a reservoir 60 and a line 61 to the cathode chamber 62 of cell 43. From the cathode chamber 62, the catholyte travels by self-convection into the gas separator 63, from which the cathode gas, i.e. hydrogen, is removed. From gas separator 63, the catholyte is returned to reservoir 60. Here, the catholyte is circulated in the same manner as the anolyte. Part of the catholyte is removed from the gas separator through line 64. This is effected by means of a level regulator 65 and reservoir 60, and by valve 66. The pH value of the catholyte is about 14. Prior to the recycling of this low-lignin strong alkaline electrolyte into the cellulose process, the sodium hydroxide concentration must be adjusted, if necessary, by dilution with water, or the addition of sodium hydroxide.

In the first process stage 41 there are thus two circulations, the catholyte loop 46 and the anolyte loop 47, wherein the major part of the catholyte and the anolyte, respectively, is circulated. A lignin-containing extract with a pH value of 14, is introduced into the anolyte circulation prior to the neutralization cell 43. A lignin-containing extract with a pH value of about 9.5, is removed from the neutralization cell 43. In the catholyte circulation 46, an electrolyte, enriched with sodium hydroxide with a pH of 12, is introduced prior to cell 43. An electrolyte with a pH value of 14 is removed from the cell 43 and reused in the production of cellulose.

The lignin-containing extract obtained in the first stage with a pH of about 9.5, is introduced into the anolyte chamber 70 of cell 44 in the second process stage. This cell is also designated the flocculation cell. In the anolyte chamber 70, the lignin components are flocculated out with the simultaneous generation of oxygen at the anode. LIgnin slurry is separated from the acidic anolyte in separation means 71, and has a pH value of about 4. The lignin slurry obtained is subjected to known methods of washing, drying and processing, so that pure lignin is produced. The anolyte solution is returned through line 72 into the catholyte chamber 73 of cell 44. During its passage, water and sodium hydroxide may be added from a reservoir 74 to the anolyte, in order to compensate for the water losses occuring during the flotation, and to obtain properties favorable for the electrolytic process such as a minimum conductivity of the catholyte.

At the end of cell 44, as viewed in the flow direction of the catholyte, the catholyte is drawn off and conducted through line 75 to reservoir 60 of the catholyte cycle 46 of the first stage 41. Sodium hydroxide, and possibly water, may again be added to line 75. Methanol may further be added for the organosolv process to the catholyte, which is recycled to the cellulose process by way of installation 76.

The weakly acidic anolyte obtained at the end of the second process still contains several grams per liter of dissolved lignin-like substances, which are difficult to precipitate even with further reduction in pH. This, however, represents no disadvantage for the overall process, as the anolyte is recirculated and, finally, is again used in the alkaline cellulose digestion. Even in the case of repeated recirculation, there is no concentration of non-precipitatable, lignin-like substances in the deflocculated electrolytes. In other words, the lignin, in the final analysis, is recovered quantitatively.

By returning the weakly acidic anolyte to the first and/or second process step in the respective cathode chambers, it is possible to return the sodium hydroxide necessarily formed in the cathode chamber (in addition to hydrogen) from water, directly to the circulation loop. In the cell of the second stage, this catholyte may be conducted concurrently to the anolyte of the cell.

The two process stages are connected with each other by a recirculation of the electrolyte, and there are thus no waste waters to be discharged. The operation is thus a closed process wherein the targeted product, lignin, is obtained as a slurry in addition to hydrogen. While the system is closed, loss of liquid may occur and is replaced with water. Furthermore, an alkaline hydroxide may be added to the catholyte in the first and second process stages in order to achieve a certain minimum conductivity from the beginning.

The following examples illustrate the invention.

EXAMPLE 1

A single stage electrolytic cell with the configuration shown in FIG. 1 was used to obtain the following results.

The electrolysis cell had an anode and a cathode, the surface area of which amounted to 50 $cm^2$ each. The anode and the cathode chambers were separated by a Nafion membrane. The anode chamber was equipped at the outlet with a flotation device that comprised 300 ml. At the onset of the experiment, the anode chamber was filled with 200 ml of a lignin-containing liquor of pH 13.6. The initial filling of the catholyte consisted of 0.1 N sodium hydroxide. The cathode chamber also comprised 300 ml and was filled completely. The electrolysis was effected with 5 A=100 $mA/cm^2$. The cell voltage slowly increased from 6 V to 15 V. After an electrolysis of approximately 75 minutes, the anolyte had attained a pH of about 8. The precipitation of a viscous light brown foam began and was drawn off by means of the flotation device, and processed. Fresh lignin-containing waste liquor, with approximately 60 grams per liter dissolved lignin (pH 13.6), was then introduced continuously from the bottom into the cell (approximately 100–150 ml/h). The entire electrolyte volume, again neutralized, left the cell in the lignin-/oxygen foam through the flotation device. Approximately 40 grams of lignin were obtained from the foam per liter of the waste liquor.

EXAMPLE 2

In an experimental installation with a configuration according to FIG. 3, the neutralization and flocculation cells were connected in series. The neutralization cell had an anode and a cathode surface area of 18 $cm^2$ each.

The anode and the cathode chambers were separated by a cation exchange membrane. The cathode (expanded V2A metal) was resting directly on this membrane, while the anode (platinum) was spaced at a distance of about 1 mm from the membrane. The anode reservoir comprised approximately 200 ml. The anolyte was pumped from the reservoir, by means of a hose pump, through the cell and the gas separator, and into the circulation at a rate of approximately 8 liters per hour. This corresponds to an anode chamber volume of approximately 2 ml and to a retention time in the cell of about 0.9 seconds. The catholyte moved through the gas separator by self-convection in circulation. The reservoir was thus eliminated. The pH value of the anolyte was determined by a glass electrode. The current flow in the neutralization cell amounted to 3.6 A=200 mA/cm$^2$. The cell voltage was approximately 10/11 V. At the start of the experiment, approximately 250 ml of a lignin-containing waste liquor of pH 13.6 was added to the reservoir and pumped in circulation under electolysis. The initial filling in the catholyte circulation was 0.1 M sodium hydroxide. After approximately 120 minutes of electrolysis, the anolyte had attained a pH value of about 10. Subsequently, in intervals of approximately three minutes, taking care that the pH was less than 9.5, 10 ml of fresh waste liquor (pH 13.6), was added to the reservoir and, simultaneously, downstream of the neutralization cell, anolyte of pH 9.5 was continuously removed at the same rate. This corresponded to a flow in the neutralization cell of about 200 ml/h. The removal thus corresponded to approximately 2.5 percent of the circulating anolyte flow. The flocculation cell had a cathode and anode surface area of approximately 20 cm$^2$. The anode and the cathode chambers were separated by a cation exchange membrane. The anode chamber was opened and was provided with a flotation device. Its volume was approximately 300 ml. Electrodes were arranged at the bottom. The current flow was approximately 4 A=200 mA/cm$^2$. The cell voltage was approximately 15 V. The anolyte (pH 9.5), removed from the anolyte circulation of the neutralization cell, was introduced into the flocculation cell and electrolyzed at the rate of approximately 200 ml/h. A viscous, light brown foam of lignin flocks, deflocculated anolyte (pH 5) and anode gas (oxygen) was produced and removed by means of the flotation device. The settling of this foam yielded approximately 0.5 liters of waste liquor (deflocculated, pH 5) on a per liter bases of anolyte (pH 9). Between one and two liters of a concentrated lignin-containing foam was obtained but could not be settled further, and from which approximately 40 grams of raw lignin were obtained by drying. The deflocculated waste liquor (pH 5) was again mixed continuously, following the settling of the foam and filtration, with the catholyte of the neutralization cell (approximately 100 ml/h), and sodium hydroxide (pH 14) removed continuously at the same rate. This sodium hydroxide was returned, after suitable dilution and solvent addition, to the cellulose pumping process.

EXAMPLE 3

The two stage process of FIG. 3 was again used as in the previous example. A further flocculation cell with a settling device preceding it, was connected in series after the flocculation cell, and both cells were operated at 2A. The first flocculation cell produced a foam at approximately pH 7, which settled over a period of time, into an electrolyte of pH 7. The lignin flock precipitated (about 10% of the total content) was filtered, and the anolyte conducted into the second flocculation cell. The second cell produced a foam as in the previous example. The cell voltages amounted, in the flocculation cells, to 7 and 7.5 V, respectively.

What is claimed is:

1. A process for obtaining lignin from an alkaline lignin solution, comprising:

anodically acidifying the alkaline lignin solution by electrolysis;

precipitating lignin from the solution; and cathodically regenerating and recovering alkali from the solution.

2. The process of claim 1, wherein the process is carried out continuously.

3. The process of claim 2, further comprising:

feeding an alkaline lignin solution to the anode chamber of an electrolytic cell containing anode and cathode chambers, separated by a cation exchange membrane;

anodically acidifying the solution in the anode chamber, and forming a precipitate of lignin foam thereby;

simultaneously regenerating the alkali in the cathode chamber after ion exchange of alkali ions across the membrane;

separating the lignin foam into lignin and an acidic anolyte; and recovering the lignin and the alkali.

4. The process of claim 3, wherein the process is carried out at a temperature slightly less than the boiling point of the alkaline solution.

5. The process of claim 4, wherein the alkaline lignin solution is an extract or waste liquor from a cellulose process.

6. The process of claim 5, wherein the acidic anolyte obtained in separating the lignin foam is recycled to the cellulose process.

7. The process of claim 6, wherein the alkali is sodium hydroxide.

8. The process of claim 7, wherein the alkaline lignin solution is the extract from an organosolv process for the production of cellulose, from which the organic solvent has first been removed.

9. The process of claim 8, wherein dilute alkaline liquor, water, or the acidic anolyte is fed to the cathode chamber.

10. The process of claim 9, wherein the lignin foam separating step includes forming a lignin suspension by flotation.

11. The process of claim 9, wherein the lignin foam separating step includes centrifuging to form pure lignin and a centrifugate comprising the acidic anolyte.

12. A multistage process for obtaining lignin from an alkaline lignin solution, comprising:

anodically acidifying the alkaline lignin solution by electrolysis, in a first stage, to a pH corresponding to the onset of lignin precipitation;

thereafter further acidifying the solution in succeeding stages to effect precipitation of the lignin.

13. The process of claim 12, wherein the process is carried out continuously.

14. The process of claim 13, wherein the process has two stages.

15. The process of claim 14 including:

feeding an alkaline lignin solution to the anode chamber of a first electrolytic cell containing anode and cathode chambers separated by a cation exchange membrane;

anodically acidifying the solution in the anode chamber to a pH corresponding to the onset of lignin precipitation, and forming a first anolyte solution thereby;

simultaneously regenerating the greater portion of the alkali in the cathode chamber after ion exchange of alkali ions across the membrane, and forming a first catholyte solution thereby;

passing the first anolyte solution from the anode chamber of the first cell to the anode chamber of a second electrolytic cell having anode and cathode chambers separated by a cation exchange membrane;

further anodically acidifying the first anolyte solution in the anode chamber of the second cell and forming a precipitate of lignin foam thereby;

simultaneously further cathodically regenerating alkali from the first anolyte solution in the cathode chamber of the second cell after ion exchange of alkali ions across the cation exchange membrane, forming a second catholyte solution thereby;

separating the lignin foam into lignin and a second anolyte solution; and recovering the lignin.

16. The process of claim 15, further including recycling the second anolyte solution to the cathode chamber of the second electrolytic cell;

passing the catholyte from the cathode chamber of the second cell to the cathode chamber of the first cell; and recovering the alkali from the catholyte of the first cell as an alkali solution.

17. The process of claim 15, wherein the process includes recycling the second anolyte solution to the catholyte chamber of the first electrolytic cell, and recovering the alkali from the catholyte of the first cell as an alkali solution.

18. The process of claim 16, wherein the alkaline lignin solution is an extract or waste liquor from a cellulose process.

19. The process of claim 18, wherein the process includes adjusting the concentration of the recovered alkali solution and recycling the alkali solution to the cellulose process as the digesting medium, or a component thereof.

20. The process of claim 19, wherein the alkaline lignin solution is anodically acidified in the first electrolysis cell to a pH of about 9.5.

21. The process of claim 20, wherein the first anolyte solution is anodically acidified in the second electrolysis cell to a pH of about 4.

22. The process of claim 21, wherein the process is carried out at a temperature slightly less than the boiling point of the alkaline lignin solution.

23. The process of claim 22, wherein the lignin foam separating step includes forming a lignin suspension by flotation.

24. The process of claim 23, wherein the process includes continuously circulating the first anolyte and catholyte solutions by passing the solutions from the anode and cathode chambers of the first cell separately through respective gas separators for removal of anodically and cathodically generated oxygen and hydrogen gases, passing the solutions from the gas separators to respective reservoirs, and returning the solutions to the anode and cathode chambers of the first electrolytic cell.

25. The process of claim 24, wherein the alkali concentration of the first and second catholytes is adjusted by adding thereto additional alkali or water or both.

26. The process of claim 25, wherein the alkali concentration adjustment to the first catholyte is made at the catholyte reservoir.

27. The process of claim 26, wherein the alkali concentration in the second catholyte is adjusted to a value consistent with minimum conductivity of the catholyte.

28. The process of claim 27, wherein the alkali is sodium hydroxide.

* * * * *